US006695724B2

(12) United States Patent
Birss

(10) Patent No.: US 6,695,724 B2
(45) Date of Patent: Feb. 24, 2004

(54) HOCKEY GOAL WITH POSITIONABLE TARGET GOAL NETS

(76) Inventor: Arthur Birss, 17 9th Ave. E, Whitehorse, YT (CA), Y1A 4H2

( * ) Notice: Subject to any disclaimer, the term of this patent is extended or adjusted under 35 U.S.C. 154(b) by 0 days.

(21) Appl. No.: 10/125,032

(22) Filed: Apr. 17, 2002

(65) Prior Publication Data

US 2003/0199342 A1 Oct. 23, 2003

(51) Int. Cl.[7] ..... A63B 69/00
(52) U.S. Cl. ..... 473/446; 273/392
(58) Field of Search ..... 473/446, 454, 473/439, 422; 273/402, 392, 400

(56) References Cited

U.S. PATENT DOCUMENTS 3,197,208 A * 7/1965 Makar ..... 473/190
3,944,223 A 3/1976 Bromwell
4,842,283 A * 6/1989 LeBel et al. ..... 273/392
D361,609 S 8/1995 Bartlett
5,634,640 A 6/1997 McCarrel
5,725,444 A 3/1998 Heden
5,888,153 A * 3/1999 Masin ..... 473/446
5,895,330 A 4/1999 Reilly, Jr.
6,012,994 A 1/2000 Beluse

* cited by examiner

*Primary Examiner*—Stephen Blau
*Assistant Examiner*—M. Chambers
(74) *Attorney, Agent, or Firm*—Gene Scott-Patent Law & Venture Group

(57) ABSTRACT

A hockey field goal apparatus comprises a frame providing a rigid structure including a pair of spaced apart and vertically oriented lateral legs and also a central vertical leg. The legs define an open face of the goal apparatus. A net is fixed to the frame for defining a defensive space within the goal apparatus. A plurality of relatively small target nets are selectively engaged with the legs of the rigid structure, wherein each of the target nets is positioned within the defensive space. The target nets each provide a biasing spring adapted for absorbing the energy of a puck received at high velocity within the target net during puck shooting practice.

3 Claims, 1 Drawing Sheet

HOCKEY GOAL WITH POSITIONABLE TARGET GOAL NETS

BACKGROUND OF THE INVENTION

1. Field of the Invention

This invention relates generally to goal structures for field sports and more particularly to such a structure employing target nets.

2. Description of Related Art

The following art defines the present state of this field:

Bartlett, U.S. Des. Pat. No. 361,609 describes a target for hockey practice.

Bromwell, U.S. Pat. No. 3,944,223 describes a hockey-type goal structure which may be readily set up in a yard, street or on ice. The goal is formed of a retangular frame that supports a canvas sheet fitted with peripheral openings in a plane generally incluined to the horizontal surface on which the device is mounted. The canvas sheet is fastened by tension springs to a frame so that a ball or puck striking the canvas is rebounded away from the structure, while a ball or puck entering one of the peripheral openings is scored as a goal.

McCarrel, U.S. Pat. No. 5,634,640 describes a sports target system adapted for use in connection with a backdrop, that is generally composed of at least one resiliently stretchable cord having hooks at each end thereof, such as a conventional stretch cord, and at least one flaccidly flexible target, such as a cloth material having a predetermined color and/or indicia thereupon. The target is provided with a loop for receiving slidably therein the resiliently stretchable cord. In operation, the user places one or more targets onto the resiliently stretchable cord by passage of the resiliently stretchable cord through the loop of each of the targets. The hooks at each end of the resiliently stretchable cord are then hookably engaged with the left and right sides of the backdrop, such as the frame of a hockey goal. The one or more targets which hang downwardly from the resiliently stretchable cord, are now slid into a selected target practice position. A selectively removable target may be provided having a loop which is selectively openable and closable, such as by a hook and loop fastener, so that the removable target may be added or removed even while the resiliently stretchable cord is strung across the backdrop.

Heden, U.S. Pat. No. 5,725,444 describes a device for training soccer players having a rectangular net body and a plurality of pockets. The rectangular net body and pockets are made of flexible net material. The rectangular net body has a plurality of apertures. Each pocket is attached to the perimeter of each aperture and sized to receive at least one soccer ball. The training device may be used in conjunction with a game to develop a player's foot and shooting skills.

Masin, U.S. Pat. No. 5,888,153 describes a target in a desired position such that the shooter strikes or otherwise directs a projectile at the target. In this invention, the target is portable and can be connected to a fixed object such as the frame of a hockey net. The target is a band of steel or other sturdy material and of any desired shape. A pocket is connected to the perimeter of the target for catching a hockey puck, ball or other object which is directed through the perimeter of the target. A spring is, at one end, connected to the target and, at its opposite end, connected to a clamping device such that the target, spring and clamping device, can be connected to a fixed object such as the goal post or crossbar of a hockey net. The shot target assembly can be easily connected to and removed from a wide variety of objects. The spring can absorb any impact caused by a projectile hitting the target without displacing the shot target assembly and without causing damage to the target.

Reilly, Jr., U.S. Pat. No. 5,895,330 describes a modified sports goal that is adapted for training a sports player to direct objects into preferred target areas. A modified goalpost frame is formed in the shape of a preferred target area of a standard sports goal. A net is coupled to the goalpost frame. The goalpost and net capture objects, such as hockey pucks, directed into the preferred target area, and allow misdirected objects which otherwise would have been captured by the standard sports goal to pass thereby. In this manner, a participant is rewarded with the feeling of achieving a goal only if the object enters the target areas. Otherwise, the object passes by the goal. This goal reduces the need for goaltenders during practice sessions, mitigating the possibility of goaltender injury and improving the shooter's ability to develop skills.

The prior art teaches a variety of field goals but does not teach a goal with target nets which are adapted for variable selective placement and shock absorbtion. The present invention fulfills these needs and provides further related advantages as described in the following summary.

SUMMARY OF THE INVENTION

The present invention teaches certain benefits in construction and use which give rise to the objectives described below.

A hockey field goal apparatus comprises a frame providing a rigid structure including a pair of spaced apart and vertically oriented lateral legs and also a central vertical leg. The legs define an open face of the goal apparatus. A net is fixed to the frame for defining a defensive space within the goal apparatus. A plurality of relatively small target nets are selectively engaged with the legs of the rigid structure, wherein each of the target nets is positioned within the defensive space. The target nets each provide a biasing spring adapted for absorbing the energy of a puck received at high velocity within the target net during puck shooting practice.

A primary objective of the present invention is to provide an apparatus and method of use of such apparatus that provides advantages not taught by the prior art.

Another objective is to provide such an invention capable of providing improved target practice to a hockey team.

A further objective is to provide such an invention capable of receiving high speed pucks into small pockets without undue stress placed on the nets of such pockets.

A still further objective is to provide such an invention capable of adjustably positioning the small net pockets.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

Figure 1:
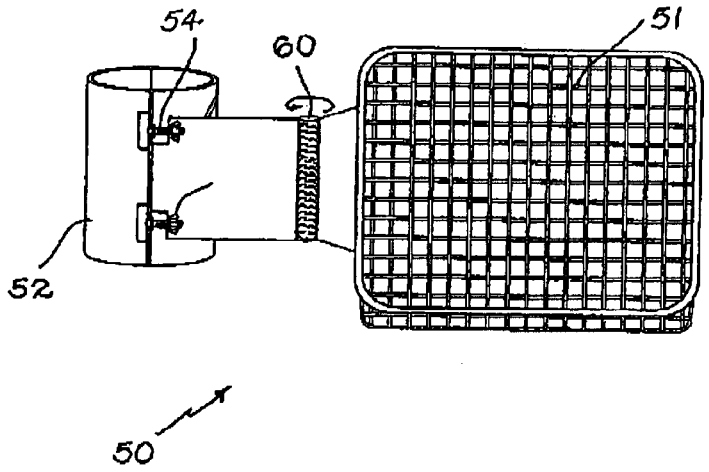
FIG. 1 is a front elevational view of a target net pocket of the preferred embodiment of the invention.

The above described drawing figures illustrate the invention in at least one of its preferred embodiments, which is further defined in detail in the following description.

The present invention is a hockey field goal apparatus comprising a frame 10 providing a rigid structure having a pair of spaced apart and vertically oriented lateral legs 20. The lateral legs 20 define an open face of the goal apparatus. A net 30 is fixed to the frame in a manner that is well known in the art. The net 30 defines a defensive space 40 within the goal apparatus, i.e., a space 40 that must be defended so that an opponents puck does not enter it. A plurality of target nets 50 are selectively engaged with the lateral legs 20 of the rigid structure, and each of the target nets 50 is extensive within the defensive space 40, i.e., positioned in front of the net 30 so that pucks directed into the goal apparatus may be captured by one of the target nets 50. The target nets 50 each provide a biasing means 60 adapted for absorbing the kinetic energy of a puck received at high velocity within the target net 50.

Figure 2:
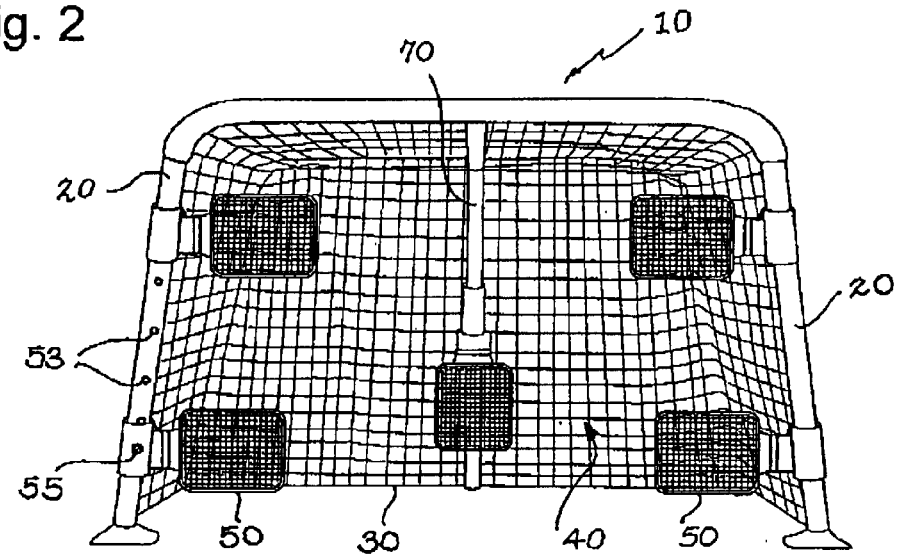
FIG. 2 is a front elevational view of the invention showing possible positions for such target net pockets.

A centrally positioned and vertically oriented leg 70 may receive at least one of the target nets 50, in the manner shown in FIG. 2.

Preferably, the lateral legs 20 and the centrally positioned leg 70 of the goal apparatus are comprised of round tubing and the target nets 50 each provide a circular clamp 52 adapted for encircling and gripping one of the legs 20, 70 of the apparatus for supporting the target nets 50 in a selected and adjustable position on the legs, such position being adjustable vertically by simply loosening the circular clamp 52 and manually sliding the target net 50 to a desired location on the leg 20, 70. Clearly, such a clamp 52 may be fashioned as shown in FIG. 1 with screws 54 and wing nuts 56. It should be noted that the legs and clamps may also be square or rectangular rather than round at the option of the fabricator.

The biasing means 60 is preferably a coil spring such as is conventionally used for closing a screen door, where the spring is forced to compress and expand radially. The spring is positioned, as shown in FIG. 1, between a net pocket 51 of the target net 50 and circular clamp 52 so that when a puck (not shown), is driven into the net pocket 51, the net pocket 51 is able to rotate against the spring giving up kinetic energy to the spring rather than to the net pocket 51 which might otherwise tear under such force.

Preferably positions may be established by placing bumps 53 on the legs 20, 70 and apertures 55 on the clamps 52 so that one may repetitively relocate the target nets 50 at desired locations.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A hockey field goal apparatus comprising: a frame having a pair of spaced apart and vertically oriented lateral legs, the lateral legs defining an open face of the goal apparatus; a net fixed to the frame, the net defining a defensive space within the goal apparatus; and a plurality of target nets selectively engaged with the legs of the frame, each of the target nets positioned within the defensive space, the target nets each providing a biasing means adapted for absorbing energy of a puck received at high velocity within the target net; each of the target nets providing a clamp adapted for gripping one of the legs for supporting the target net in a selected attitude thereon; the clamp having an aperture thereon and the legs providing plural bumps such that the aperture may be engaged with one of the bumps enabling secure positioning of the clamp on the one of the legs.

2. The apparatus of claim 1 further including a centrally positioned, vertically oriented leg engaging at least one of the target nets.

3. The apparatus of claim 1 wherein the biasing means is a spring positioned between a net pocket of the target net and a circular clamp of the target net.

* * * * *